United States Patent [19]

Knott

[11] 4,080,812

[45] Mar. 28, 1978

[54] AUTOMOBILE TRUNK LOCK

[75] Inventor: Joseph C. Knott, Prince George, Va.

[73] Assignee: Helen H. Knott, Prince George, Va.

[21] Appl. No.: 750,377

[22] Filed: Dec. 14, 1976

Related U.S. Application Data

[63] Continuation-in-part of Ser. No. 583,429, Jun. 3, 1975, abandoned.

[51] Int. Cl.[2] ..... E05B 65/12

[52] U.S. Cl. ..... 70/256; 70/373; 70/465; 292/DIG. 43; 292/DIG. 65

[58] Field of Search ..... 292/216, 92, 93, DIG. 42, 292/DIG. 43, DIG. 65, DIG. 71; 70/92, 240, 379, 380, 451, DIG. 60, 372, 373, 391, 357, 362, 465, 256

[56] References Cited

U.S. PATENT DOCUMENTS

| | | | |
|---|---|---|---|
| 1,550,379 | 8/1925 | Manteufel | 70/380 |
| 3,016,968 | 1/1962 | Lenz et al. | 70/256 |
| 3,062,033 | 11/1962 | Schmalfeldt | 70/256 |
| 3,209,563 | 10/1965 | Pelcin | 292/DIG. 71 |
| 3,868,836 | 3/1975 | LaRoche | 70/240 |
| 3,992,909 | 11/1976 | McGhee | 70/465 |

*Primary Examiner*—Kenneth J. Dorner
*Attorney, Agent, or Firm*—Shlesinger, Arkwright, Garvey & Dinsmore

[57] ABSTRACT

An automobile trunk lock which permits the trunk to be opened from outside or inside thereof. One end of a release arm is connected to a cylinder lock in the trunk lid and the opposite end extends through the latch release of a latch mechanism. A key is engaged with the inner terminal of the release arm. Actuation of the cylinder lock by a key or rotation of the interior key effects rotation of the release arm about its longitudinal axis to trip the latch release to disengage the latch mechanism and open the trunk.

4 Claims, 7 Drawing Figures

AUTOMOBILE TRUNK LOCK

This application is a continuation-in-part of application Ser. No. 583,429 filed June 3, 1975 now abandoned.

BACKGROUND AND OBJECTS

With ever increasing frequency, individuals are being kidnapped and taken as hostages and, in order to transport them from one place to another without detection, they are hidden in the trunk of an automobile. In some cases, the automobile is abandoned with the individual in the trunk or the person is simply left in the trunk for long periods of time, with resultant death or serious physical harm due to lack of air or exposure to cold or heat. Up to the present time, no means has been provided for opening the trunk from the interior thereof except by means of tools. Even if available, the average person would lack the necessary skill to open the trunk in the dark.

Conventional automobile trunk locks include a cylinder lock to which is attached a release arm which operatively engages the latch release of the trunk lid latch mechanism. Upon turning of the key in the lock cylinder, a rotation of the arm about its longitudinal axis is effected which trips the latch release to disengage the latch mechanism and open the trunk.

However, the trunk lock cannot be opened from within the trunk for two reasons. First there is no means interiorly of the trunk for rotating the arm and secondly, the construction of the lock cylinder is such that, without rotation of the lock cylinder, the release arm cannot be rotated about its longitudinal axis to a degree which will trip the latch release.

It is an object of this invention to provide an automobile trunk lock which permits the opening thereof from within the trunk as well as by use of conventional key means from outside the trunk.

Another object is to provide a lock of the character described which requires only slight modification of existing trunk locks and the addition of one part, and which, therefore, may be economically produced and applied to new automobiles, or which permits ready conversion of the trunk locks of existing automobiles.

A further object is to provide a lock of the character described wherein key means or the like are engaged with the release arm of the lock within the trunk, and which, by visual inspection by someone within the trunk, would immediately indicate the purpose and manner of actuation to actuate the latch release of the trunk lock mechanism.

A further object is to provide a lock of the character described including a release arm extending from the lock to the latch mechanism of the trunk, and including actuating means attached to the release arm for rotating the arm through an arc to trip the latch mechanism and open the trunk.

Other objects will be apparent from the following description of the presently preferred form of this invention taken in connection with the appended drawings.

DETAILED DESCRIPTION OF THE INVENTION

Figure 1:
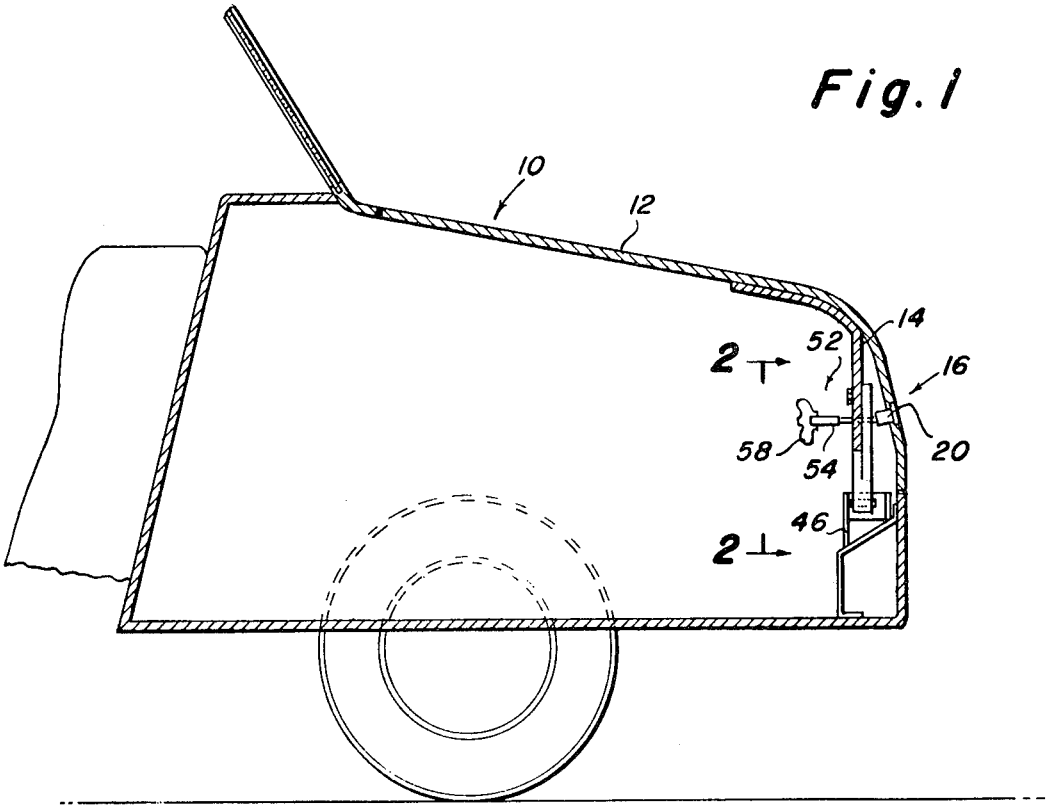
FIG. 1 is a side elevational view of the attachment for an automobile trunk lock illustrating its use.

Referring now in greater detail to the drawings, there is illustrated in FIG. 1 an automobile generally designated 10 including a trunk lid 12 provided with an internal brace 14 which supports a locking mechanism generally designated 16.

Locking mechanism 16 includes a key-operated cylinder lock 18 operated by a key 19 and adapted for rotational movement within an outer housing 20 having a slotted flange 21. Cylinder lock 18 is provided with a slotted portion 22 interiorly of the lock which is transversely cut away at 24, the cut away section extending through approximately a 180° arc of the cylinder.

In cooperation with the cylinder lock there is provided a flat release arm 26 one end of which is formed to provide a hook portion 28 which is adapted to extend through slotted portion 22 of the cylinder lock. Terminal 30 of release arm 26 is positioned in transversely cut away section 24 to permit free rotation of the arm, and has a flange 32 adapted to bear against the body of the cylinder lock for maintaining the release arm in the proper position for use. A convolute spring 34 is positioned around the slotted portion 22 of the cylinder lock, one end of the spring being secured to the slotted portion and the other end thereof to the slotted flange 21 of fixed housing 20.

In accordance with conventional practice, the opposite end of release arm 26 extends into engagement with a standard latch mechanism 36 of conventional construction which is secured to brace 14. Latch mechanism 36 includes a body portion 38 housing a spring operated trip mechanism including a cam 40, a latch 42 and a rotatable pivot rivet latch release 44, the latter having a slot extending longitudinally therethrough and through which release arm 26 extends.

Figure 2:
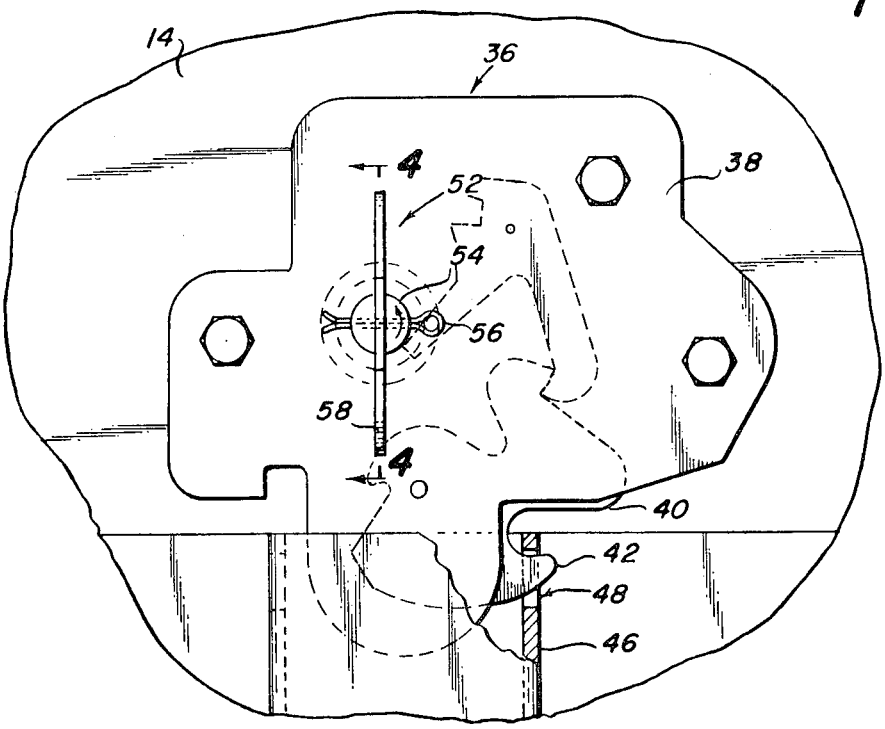
FIG. 2 is an enlarged plan view of the present attachment viewed along the line 2—2 of FIG. 1, looking in the direction of the arrow, and showing the latch mechanism in operative position.
Figure 3:
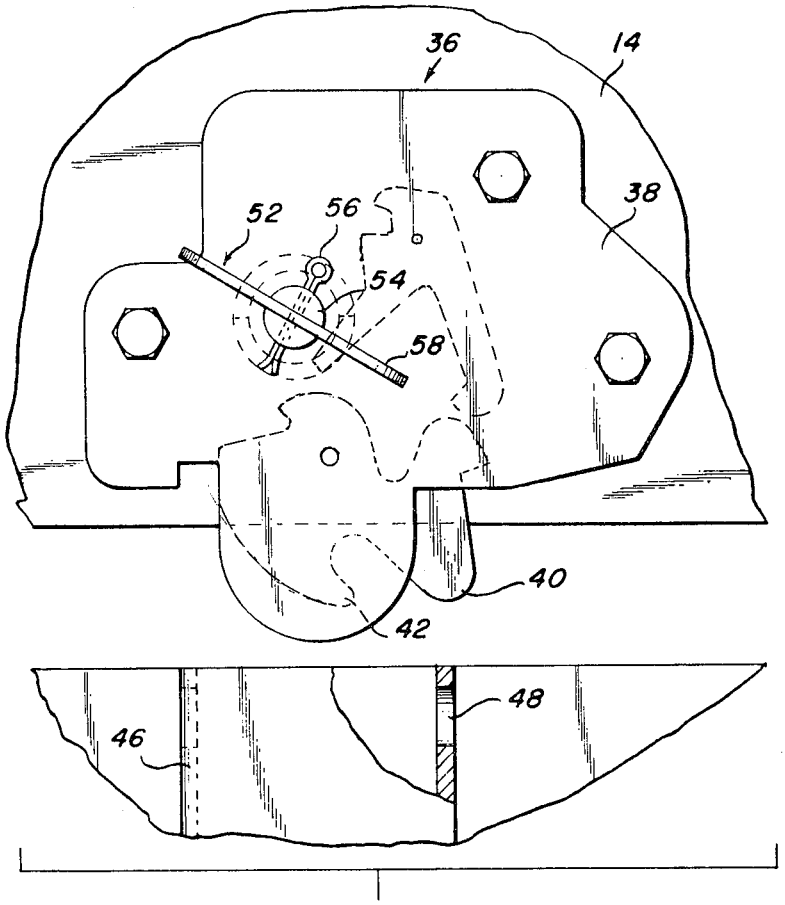
FIG. 3 is a view similar to FIG. 2, showing the latch mechanism in inoperative position.

As shown to advantage in FIGS. 2 and 3, latch mechanism 36 is adapted for operative engagement with a latch holder 46 which is affixed to the chassis of automobile 10 within the trunk and also aligned with the latch mechanism of the trunk lid when the latter is being closed. Latch holder 46 includes an opening 48 through which latch 42 passes when the trunk lid is closed. As also shown to advantage in FIGS. 2 and 3, as the latch mechanism approaches the latch holder 46, cam 40 engages the upper limit thereof forcing the cam upwardly and pivoting the latch 42 into the operative position shown in FIG. 2 to lock the trunk lid.

Figure 5:
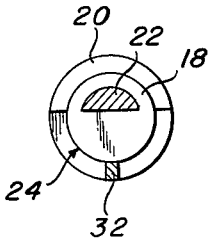
FIG. 5 is a sectional view taken along the line 5—5 of FIG. 4, looking in the direction of the arrow, and showing the lever arm forming a part of the present invention in inoperative position.
Figure 6:
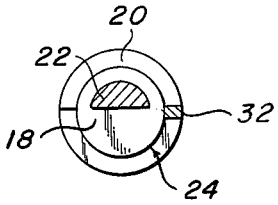
FIG. 6 is a view similar to FIG. 5, showing the lever arm in operative position.
Figure 7:
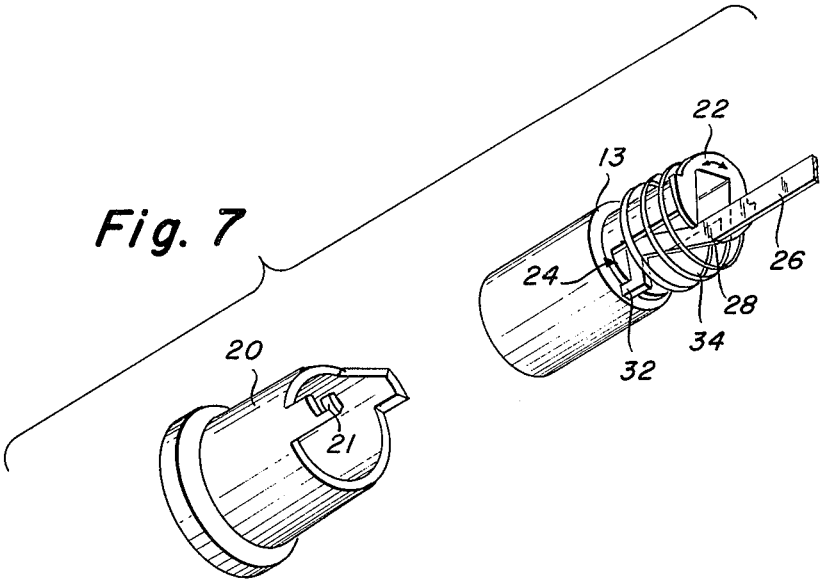
FIG. 7 is a perspective view of the lock cylinder forming a part of the present invention.

In accordance with the objects of the present invention, release arm 26 extends through pivot rivet latch release 44 and upon rotation of cylinder lock 18, release arm 26 is engaged by slotted portion 22 of the cylinder lock defining cut away section 24, causing the release arm to move in the manner illustrated to advantage in FIGS. 5 and 6. This rotation in turn effects a corresponding rotation of the release arm 26 as it passes through pivot rivet latch release 44, thereby rotating the latter to effect movement of latch 42 in a direction to disengage the same from latch holder 46.

Release arm 26 extends through and beyond latch mechanism 36 to provide a stub portion 50 adapted for engagement with an actuating key 52. Actuating key 52 includes a tubular portion 54 for receiving stub portion 50 of release arm 26, the stub portion being retained within the tubular portion by a cotter pin or the like 56, thereby permitting disengagement of the actuating key from the release arm when desired. Key 52 further includes a finger-engaging body portion 58 attached to tubular portion 54 which facilitates rotation of release arm 26. Body portion 58 is preferably of a shape which immediately conveys to anyone within the trunk that it serves as means for opening the trunk.

Figure 4:
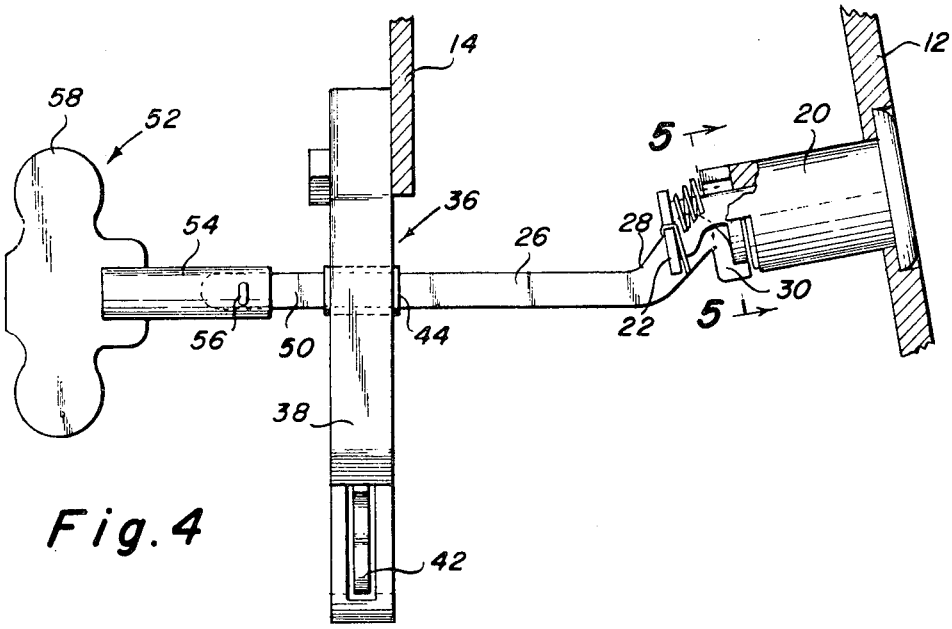
FIG. 4 is a sectional view taken along the line 4—4 of FIG. 2, looking in the direction of the arrow, portions thereof being shown in elevation.

Therefore, in addition to the ability to release latch mechanism 36 by means of the conventional key engaged with cylinder lock 18, it is also possible to release the latch mechanism independently of the rotation of cylinder lock 18 by rotation of release arm 26 by operation of key 52 as indicated in FIG. 4. This is made possible by the fact that terminal portion 30 of lever arm 26 is positioned within the cut away section 24 of the cylinder lock, thereby permitting limited, but sufficient rotational movement of the release arm to effect unlatching of mechanism 36. A rotation of release arm 26 through an arc of approximately 90° is necessary to trip latch release 44.

With the present invention, therefore, trunk lid 12 may be opened from the outside by a key engaged with cylinder lock 18, or by manual manipulation of key 52 from within the trunk of the automobile.

In adapting the standard type of automobile trunk lock for use in accordance with the present invention, it is only necessary that the cut away section 24 of a standard lock be enlarged to permit greater movement of release arm 26 to a degree sufficient to permit rotating of the arm to effect actuation of pivot rivet latch release 44. In addition, release arm 26 is extended slightly from conventional structure to permit attachment of actuating key 52 to the stub end thereof.

The present invention therefore provides an attachment for opening the trunk of an automobile very readily, the attachment requiring only minor modification in existing equipment which may be readily and economically carried out.

While the device of the present invention has been illustrated as being applied to an automobile trunk or the like, it is of course to be understood that it may be applied to any locking arrangement employing similar apparatus and operating in a similar manner. Various changes may be made within the scope of the appended claims.

What is claimed is:

1. A locking mechanism for an automobile trunk lid having a brace member, a latch mechanism provided with a latch release supported by the brace member and a latch holder mounted on the automobile chassis for operative engagement with the latch release, the locking mechanism including:

(a) a lock housing fixedly mounted on the trunk lid
(b) a cylinder lock rotatably mounted partially within said lock housing
(c) said cylinder lock being provided with a slotted portion interiorly of the lock
(d) said slotted portion of the cylinder lock being provided with a transversely cut away section
(e) a release arm
(f) one end of said release arm being operatively engaged with the latch release of the latch mechanism for tripping the former to open the trunk lid, upon rotation of the release arm through an arc of approximately 90° about its longitudinal axis
(g) the opposite end of said release arm being of hook shape
(h) said hook shape portion of the release arm extending into the transversely cut away section of said slotted portion
(i) key means for actuating said cylinder lock exteriorly of the trunk lid by rotating the cylinder lock relative to the lock housing and effecting a corresponding rotation of said release arm by virtue of the engagement of the hook end of the release arm thereof by that part of the slotted portion adjacent the transversely cut away section, and
(j) means connected with said one end of said release arm for rotating said release arm in an arc about its longitudinal axis relative to said cylinder lock while the latter is stationary, to trip the latch release and open the trunk lid.

2. The locking mechanism of claim 1, wherein:

(a) said cut away section extends through an arc of approximately 180° of the slotted portion of said cylinder lock.

3. The locking mechanism of claim 1, wherein:

(a) said means comprises a key.

4. The locking mechanism of claim 1, with the addition of:

(a) a convolute spring positioned around the slotted portion of the cylinder lock, one end of the convolute spring being secured to the slotted portion thereof, and the other end thereof secured to said lock housing.

* * * * *